United States Patent [19]

Cummings

[11] 4,144,036

[45] Mar. 13, 1979

[54] DETERGENT FUEL COMPOSITION

[75] Inventor: William M. Cummings, Fishkill, N.Y.

[73] Assignee: Texaco Inc., New York, N.Y.

[21] Appl. No.: 890,106

[22] Filed: Mar. 27, 1978

[51] Int. Cl.[2] ..... C10L 1/22

[52] U.S. Cl. ..... 44/71; 252/394; 252/392

[58] Field of Search ..... 44/71; 252/392, 394; 260/534 M

[56] References Cited

U.S. PATENT DOCUMENTS

| | | | |
|---|---|---|---|
| 3,773,479 | 11/1973 | Dorn et al. | 44/71 |
| 3,980,448 | 9/1976 | Haemmerle et al. | 252/394 |
| 4,018,702 | 4/1977 | Boffardi et al. | 252/392 |
| 4,047,900 | 9/1977 | Dorn et al. | 44/71 |

*Primary Examiner*—Winston A. Douglas
*Assistant Examiner*—Y. Harris-Smith
*Attorney, Agent, or Firm*—Thomas H. Whaley; Carl G. Ries; James J. O'Loughlin

[57] ABSTRACT

Motor fuel composition comprising a mixture of hydrocarbons in a gasoline boiling range containing a polyether reaction product on an asparagine represented by the formula:

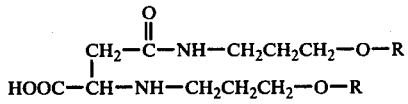

in which R is an aliphatic hydrocarbon radical having from about 10 to 20 carbon atoms.

6 Claims, No Drawings

DETERGENT FUEL COMPOSITION

BACKGROUND OF THE INVENTION

1. Field of the Invention

Modern internal combustion engine design is undergoing important changes to meet new federal standards concerning engine exhaust gas emissions. A major change in engine design recently adopted is the feeding of blow-by gases from the crankcase zone of the engine into the intake air supply to the carburetor rather than venting these gases to the atmosphere as in the past. Further changes adopted involve recycling a part of the exhaust gases to the combustion zone of the engine in order to minimize objectionable emissions. The blow-by gases from the crankcase zone and the recycled exhaust gases both contain significant amounts of deposit-forming substances which promote the formation of deposits in and around the throttle plate area of the carburetor. These deposits restrict the flow of air through the carburetor at idle and at low speeds so that an overrich fuel mixture results. This condition produces rough engine idling and stalling, and serves to increase the undesirable exhaust emissions which the engine design changes are intended to overcome.

Modern gasoline compositions are very highly refined products. Despite this, they contain minor amounts of impurities which can promote corrosion during the period that the fuel is transported and stored and even in the fuel tank, fuel lines and carburetor of the motor vehicle. A commercial motor fuel composition must contain a corrosion inhibitor to inhibit or prevent corrosion.

2. Description of the Prior Art

U.S. Pat. No. 3,773,479 discloses a major fuel composition containing a substituted asparagine having the formula:

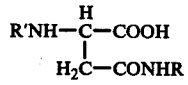

in which R and R' each represent secondary or tertiary alkyl or alkylene radicals having from seven to twenty carbon atoms.

A copending application disclosing a motor fuel composition containing the polyether reaction product of an asparagine was filed on Mar. 27, 1978 under Ser. No. 890,104.

A copending application disclosing a motor fuel composition containing an aliphatic hydrocarbon polyether substituted succinamic acid compound was filed on Mar. 27, 1978 under Ser. No. 890,105.

SUMMARY OF THE INVENTION

A class of polyether substituted reaction products of an asparagine are provided as carburetor detergents and corrosion inhibitors when employed in a liquid hydrocarbon fuel for an internal combustion engine. The reaction products are characterized by having a plurality of alkyloxytrimethylene radicals attached to the asparagine base and exhibit surprisingly effective carburetor detergency and corrosion inhibiting properties.

The fuel composition of the invention prevents or mitigates the problem of corrosion and deposits laydown in the carburetor of an internal combustion engine. When a gasoline of the engine is employed in a carburetor which already has a substantial build-up of deposits from prior operations, a rather severe test of the detergency property of a fuel composition, this gasoline is effective for removing substantial amounts of the preformed deposits.

DESCRIPTION OF THE PREFERRED EMBODIMENTS

The polyether reaction product of an asparagine of the invention is represented by the formula:

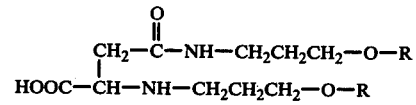

in which R represents an aliphatic hydrocarbon radical having from 10 to 20 carbon atoms. A preferred reaction product for the fuel composition of the invention is one in which R is a saturated aliphatic hydrocarbon radical having from 13 to 18 carbon atoms.

Methods for preparing the additive of the invention are well known and do not constitute a part of this invention. In a preferred method, an ether amine is reacted with maleic anhydride to produce the reaction product. Approximately two moles of the ether amine are reacted with a mole of maleic anhydride at a temperature ranging from about room temperature up to about 95° C. to produce the reaction product. This reaction is illustrated by the following formula:

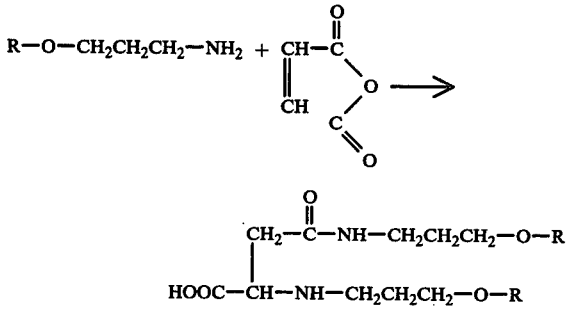

It will be appreciated that the product of the reaction can be a mixture of compounds conforming to the alternate versions of the formula given above. It will also be understood that mixtures of the prescribed compounds can be effectively employed as additives in a motor fuel composition of the invention.

The following examples illustrate the preferred method for preparing the additive of the invention:

EXAMPLE I (Prep. FR 32-382-12)

49 Grams (0.5 moles) of maleic anhydride were added to 240 grams of a mineral oil having a viscosity in centistokes at 210° F. of about 4. 265 Grams (1.0 moles) of tridecoxypropylamine (Armour ethereamine-13) was added to the oil solution of the maleic anhydride forming a reaction mixture. This mixture was heated to about 104° F., and maintained at this temperature for about 1.5 hours. The mixture was then cooled and the product analyzed with the following results:

| | |
|---|---|
| TBN | 34.5 |
| TAN | 59.7 |
| % N | 2.13 |

-continued

| | |
|---|---|
| Kin Vis at 100° F | 256.9 |
| at 210° F | 15.56 |
| Sp. Grav. | 0.9273 |

The ether amine anhydride reaction product obtained was N,N'-di-(tridecoxypropyl)asparagine and is represented by the formula:

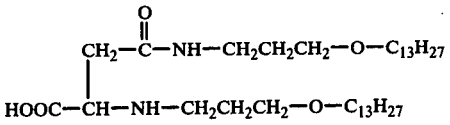

EXAMPLE II

49 Grams (0.5 moles) of maleic anhydride are added to 240 grams of mineral oil. 335 grams (1.0 moles) of octodecoxypropylamine are added to the oil solution of the maleic anhydride forming a reaction mixture. This mixture is heated and reacted as in Example I above. A substantial yield of N,N'-di-(octodecoxypropyl)asparagine will be produced.

Examples of other effective additives of the invention include:

N,N'-di-(hexadecoxypropyl)asparagine
N,N'-di-(tetradecoxypropyl)asparagine
N,N'-di-(decoxypropyl)asparagine The base fuel which is useful for employing the additive of the invention is a motor fuel composition comprising a mixture of hydrocarbons boiling in the gasoline boiling range. This base fuel may consist of straight-chain or branched-chain paraffins, cycloparaffins, olefins, and aromatic hydrocarbons and any mixture of these. The base fuel can be derived from straight-run naphtha, polymer gasoline, natural gasoline or from catalytically cracked or thermally cracked hydrocarbon and catalytically reformed stocks and boils in the range from about 80° to 450° F. The composition and the octane level of the base fuel are not critical. Any conventional motor fuel base can be employed in the practice of this invention.

In general, the additive of the invention is added to the base fuel in a minor amount, i.e., an amount effective to provide corrosion inhibitor or carburetor detergency or both to the fuel composition. The additive is effective in an amount ranging from about 0.0002 to 0.2 weight percent based on the total fuel composition. An amount ranging from about 0.001 to 0.01 weight percent is preferred, the latter amounts corresponding to about 3 to 30 PTB (pounds of additive per 1000 barrels of gasoline) respectively.

The fuel composition of the invention may contain any of the additives normally employed in a motor fuel. For example, the base fuel may be blended with an anti-knock compound, such as methyl-cyclopentadienyl manganese tricarbonyl or tetraalkyl lead compound, including tetraethyl lead, tetramethyl lead, tetrabutyl lead, and chemical and physical mixtures thereof, generally in a concentration from about 0.025 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide. The motor fuel composition may also be fortified with any of the conventional anti-icing additives, corrosion inhibitors dyes and the like.

Gasoline blends were prepared from a typical base fuel mixed with specified amounts of the prescribed fuel additive of the invention. The additive of the invention was tested for its effectiveness in gasoline in the following performance tests.

The additive of the invention was tested for its effectiveness as a carburetor detergent in the Carburetor Detergency Test. This test is run on a Chevrolet V-8 engine mounted on a test stand using a modified four barrel carburetor. The two secondary barrels of the carburetor are sealed and the feed to each of the primary barrels arranged so that an additive fuel can be run in one barrel and the base fuel run in the other. The primary carburetor barrels were also modified so that they had removable aluminum inserts in the throttle plate area in order that deposits formed on the inserts in this area would be conveniently weighed.

In the procedure designed to determine the effectiveness of an additive fuel to remove preformed deposits in the carburetor, the engine is run for period of time usually 24 to 48 hours using the base fuel as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blow-by to the inlet in the carburetor body. The inserts are then removed from the carburetor and weighed to determine the difference between the performance of the additive and reference fuels in removing the preformed deposits. After the aluminum inserts are cleaned, they are replaced in the carburetor and the process repeated with the fuels reversed in the carburetor to minimize differences in fuel distribution and barrel construction. The deposit weights in the two runs are averaged and the effectiveness of the fuel composition of the invention is compared to the reference fuel which contains an effective detergent additive. The difference in effectiveness is expressed in percent, a positive difference indicating that the fuel composition of the invention was more effective than the commercial fuel composition.

The base fuel employed with the detergent additive of the invention in the following examples was a premium grade gasoline having a Research Octane Number of about 95 and contained 4.0 cc of tetraethyl lead per gallon. This gasoline consisted of about 28% aromatic hydrocarbons. 10.5% Olefinic hydrocarbons and 61.5% paraffinic hydrocarbons and boiled in the range from 90° F. to 379° F.

The carburetor detergency test results obtained with the fuel composition of the invention in comparison to two commercial detergent fuel compositions referred to as Reference Fuel A and Reference Fuel B, are set forth in the Table below.

TABLE I

CARBURETOR DETERGENCY TEST

| Run | Additive Fuel Composition | % Effective |
|---|---|---|
| 1. | Base Fuel + 10 PTB of Example I vs Ref. Fuel A (contains 15 PTB of a commercial detergent) | −7 |
| 2. | Base Fuel + 40 PTB of Examples I vs Ref. Fuel B (contains 173 PTB of a | −14 |

TABLE I-continued

| CARBURETOR DETERGENCY TEST | | |
|---|---|---|
| Run | Additive Fuel Composition | % Effective |
| | commercial detergent) | |

PTB = Pounds of Additive per 1000 Barrels of Fuel.

The foregoing tests show that the fuel composition of the invention was highly effective in its carburetor detergency property and that its performance is comparable to or superior to commercial detergent fuel compositions.

The corrosion inhibiting properties of a gasoline composition of the invention was determined in a corrosion test designated the Colonial Pipeline Rust Test. In this test, a steel specimen, polished with non-waterproof fine emery paper is immersed in 300 ml of stirred test fuel at 100° F. for 30 min. Then 30 ml distilled water is added and stirred for 3.5 hours. The specimen is visually rated and a rating >5% rust is considered passing.

The Base Fuel employed in this test was identical to the Base Fuel used in the Examples of Table I above. The results are given in the Table below.

TABLE II

| COLONIAL PIPELINE RUST TEST | | |
|---|---|---|
| Run | Additive & Conc. | % Rust |
| 1. | None | 75 to 95 |
| 2. | 2 PTB of Example I | Trace |

The foregoing test shows that the fuel composition of the invention is surprisingly effective as a corrosion-inhibited motor fuel composition.

I claim:

1. A motor fuel composition comprising a mixture of hydrocarbons in the gasoline boiling range containing from about 0.0002 to 0.2 weight percent of a polyether reaction product of an asparagine represented by the formula:

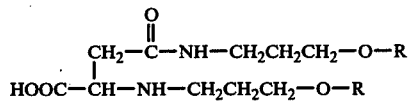

in which R represents an aliphatic hydrocarbon radical having from about 10 to 20 carbon atoms.

2. A motor fuel composition according to claim 1 in which R represents a saturated aliphatic hydrocarbon radical having from 13 to 18 carbon atoms.

3. A motor fuel composition according to claim 1 in which R represents a branched-chain, saturated aliphatic hydrocarbon radical.

4. A motor fuel composition according to claim 1 containing from about 0.0001 to 0.1 weight percent of said reaction product.

5. A motor fuel composition according to claim 1 in which said reaction product is N,N'-di-(tridecoxypropyl)asparagine.

6. A motor fuel composition according to claim 1 in which said reaction product is N,N'-di-(octodecoxypropyl)asparagine.

* * * * *